US007305948B2

(12) United States Patent
Heintzen et al.

(10) Patent No.: US 7,305,948 B2
(45) Date of Patent: Dec. 11, 2007

(54) DEVICE FOR CHANGING THE TIMING OF AN INTERNAL-COMBUSTION ENGINE

(75) Inventors: Dirk Heintzen, Weisendorf (DE); Gregory Muller, Troy, MI (US); Roger Meyer, Brighton, MI (US); Jeffrey Balko, Kingsville (CA)

(73) Assignee: Schaefler KG, Herzogenaurach (DE)

( * ) Notice: Subject to any disclaimer, the term of this patent is extended or adjusted under 35 U.S.C. 154(b) by 78 days.

(21) Appl. No.: 11/129,428

(22) Filed: May 13, 2005

(65) Prior Publication Data

US 2005/0268873 A1 Dec. 8, 2005

Related U.S. Application Data

(60) Provisional application No. 60/576,676, filed on Jun. 3, 2004.

(51) Int. Cl.
*F01L 1/34* (2006.01)

(52) U.S. Cl. ..... 123/90.17; 123/90.15; 464/160

(58) Field of Classification Search ..... 123/90.15, 123/90.16, 90.17, 90.18; 464/1, 2, 160
See application file for complete search history.

(56) References Cited

U.S. PATENT DOCUMENTS

| | | | | |
|---|---|---|---|---|
| 4,508,069 | A * | 4/1985 | Dobler et al. | 123/192.2 |
| 5,138,985 | A * | 8/1992 | Szodfridt et al. | 123/90.17 |
| 6,006,708 | A * | 12/1999 | Ken et al. | 123/90.17 |
| 6,230,675 | B1 * | 5/2001 | Kobayashi et al. | 123/90.15 |
| 6,263,843 | B1 * | 7/2001 | Todo et al. | 123/90.17 |
| 6,779,501 | B2 * | 8/2004 | Simpson et al. | 123/90.17 |

* cited by examiner

*Primary Examiner*—Ching Chang
(74) *Attorney, Agent, or Firm*—Volpe and Koenig P.C.

(57) ABSTRACT

A device (1) for changing the timing of an internal-combustion engine (2) is provided that has a camshaft adjuster (5), which is supported on a non-rotating bearing journal (6). A driving wheel (8) of the camshaft adjuster (5) is driven by a crank-shaft (3) via a first traction mechanism drive (7). The rotation of the driving wheel (8) is transferred via an actuator (10) to a driven part (9), which is arranged so that it can rotate relative to the driving wheel (8). Second and third traction mechanism drives (11, 12) create a drive connection between the driven part (9) and two camshafts (4, 4*a*).

10 Claims, 2 Drawing Sheets

DEVICE FOR CHANGING THE TIMING OF AN INTERNAL-COMBUSTION ENGINE

CROSS-REFERENCE TO RELATED APPLICATIONS

This application claims the benefit of U.S. Provisional Application No. 60/576,676, filed Jun. 3, 2004, which is incorporated herein by reference as if fully set forth.

FIELD OF THE INVENTION

The invention relates to a device for changing the control timing of an internal-combustion engine with a camshaft adjuster having a driving wheel driven by the crankshaft and with a driven part, which drives at least one camshaft and which is driven by the driving wheel via a hydraulic actuator, wherein the actuator is constructed with at least one pair of hydraulic compression chambers working against each other, and wherein a phase position between the crankshaft and the one or more camshafts can be changed by means of the actuator.

BACKGROUND

In internal-combustion engines, camshafts are used for activating the gas-exchange valves. The camshaft is mounted in the internal-combustion engine such that cams mounted on the shaft contact cam followers, for example, cup tappets, rockers, or valve lifters. If the camshaft is set in rotation, then the cams roll on the cam followers, which in turn activate the gas-exchange valves. Thus, the position and the shape of the cams set not only the opening period and also the amplitude, but also the opening and closing times of the gas-exchange valves.

Modern engine concepts tend toward designing a variable valve drive. On one hand, valve stroke and valve opening period should be able to be formed variably up to complete deactivation of individual cylinders. For this purpose, concepts such as switchable cam followers or electrohydraulic or electric valve actuators are provided. Furthermore, it has proven to be advantageous to be able to influence the opening and closing timing of the gas-exchange valves during the operation of the internal-combustion engine. It is also desirable to be able to influence the opening or closing timing of the inlet or outlet valves separately, in order to be able to set, for example, a targeted definite valve overlap. By setting the opening or closing timing of the gas-exchange valves as a function of the current characteristic field of the engine, for example, the current engine speed or the current load, the specific fuel consumption can be reduced, the exhaust behavior can be influenced positively, and the engine efficiency, the maximum torque, and the maximum output can be increased.

The described variability in the gas-exchange timing is implemented by a relative change of the phase position of the camshaft relative to the crankshaft. Here, the camshaft is in drive connection with the crankshaft usually via a chain, belt, gear, or similarly acting drive concept. A camshaft adjuster, which transfers the torque from the crankshaft to the camshaft, is mounted between the chain, belt, or gear drive driven by the crankshaft. Here, this device is embodied such that during the operation of the internal-combustion engine, the phase position is reliably held between the crankshaft and camshaft and, when desired, the camshaft can be rotated into a certain angular range relative to the crankshaft.

In internal-combustion engines with camshafts for the inlet and outlet valves, these camshafts can each be equipped with a camshaft adjuster. Therefore, the opening and closing times of the inlet and outlet gas-exchange valves are shifted in time relative to each other and the overlapping of the timing is set as desired.

The seat of modern camshaft adjusters is generally located on the drive-side end of the camshaft. It comprises a driving wheel fixed to the crankshaft, a driven part fixed to the camshaft, and an adjusting mechanism transferring the torque from the driving wheel to the driven part. The driving wheel can be embodied as a chain, belt, or gear, and is connected in a rotationally fixed manner to the crankshaft by means of a chain, belt or gear drive. The adjusting mechanism can be operated electrically, hydraulically, or pneumatically.

In hydraulically operated camshaft adjusters, one differentiates between so-called axial piston adjusters and rotary piston adjusters.

In the axial piston adjusters, the driving wheel connects to a piston by means of helical gearing. Furthermore, the piston connects to the driven part likewise via helical gearing. The piston separates a hollow chamber formed by the driven part and the driving wheel into two compression chambers arranged axially relative to each other. Now, if one compression chamber is pressurized with a hydraulic medium, for example, motor oil, while the other compression chamber is connected to an oil outlet, then the piston is displaced in the axial direction. This axial displacement creates a relative rotation of the driving wheel relative to the driven part and thus the camshaft relative to the crankshaft by means of the two helical gearing pairs.

In a rotary piston adjuster, the driving wheel is connected in a rotationally fixed manner to a stator. The stator and the driven part are arranged concentrically relative to each other. The radial intermediate space between these two components includes at least one, but usually several, hollow chambers spaced apart in the circumferential direction. The hollow chambers are bounded in a pressure-tight manner by side covers in the axial direction. A vane connected to the driven part extends into each of these hollow chambers. This vane divides each hollow chamber into two compression chambers. Through targeted connection of the individual compression chambers to a hydraulic medium pump or to a hydraulic medium outlet, the phase of the camshaft relative to the crankshaft can be set or held.

To control the camshaft adjuster, sensors detect the characteristic data of the engine, such as, for example, the load state and the engine speed. This data is fed to an electronic controller, which controls the adjusting motor of the camshaft adjuster or the inflow and outflow of hydraulic medium to the various compression chambers after comparison of the data with a characteristic data field of the internal-combustion engine.

A device for changing the timing of an internal-combustion engine is known, for example, from JP 03 026 815 A. This document describes the controlled drive of an engine provided with two banks of cylinders arranged in the shape of a V relative to each other. The engine is provided with an intake camshaft and an exhaust camshaft for each cylinder bank. The intake camshafts are driven by the crankshaft via a traction mechanism drive. A hydraulically operated camshaft adjuster is mounted on the drive-side end of each intake camshaft. Each camshaft adjuster is provided with a driving wheel, around which the traction mechanism is tensioned and a driven part fixed to the camshaft is provided. On the end faces of the intake camshafts facing away from the corresponding drive, another driving wheel for another traction mechanism drive is mounted, by means of which the corresponding exhaust camshaft is driven. To enable an adjustment of the timing between intake camshaft and exhaust camshaft, each exhaust camshaft is provided on the drive side with a camshaft adjuster.

A disadvantageous effect in this embodiment is that for driving the two intake camshafts, two camshaft adjusters are needed, wherein each camshaft adjuster is mounted on one of the intake camshafts. The use of two camshaft adjusters leads to higher costs, greater weight, and increased assembly expense for the controlled drive. Another disadvantage is that for the use of hydraulic camshaft adjusters, two pressurized hydraulic medium supply systems must be provided in the internal-combustion engine. This leads to increased adaptation expense for the surrounding components of the camshaft adjuster, such as, for example, the camshaft or the cylinder head.

SUMMARY

The invention is based on the objective of preventing these mentioned disadvantages and thus creating an economical device optimized in terms of weight and space for changing the timing of an internal-combustion engine, whose assembly expense is low. Furthermore, for this purpose, care should be taken that only a minimum of adaptations of the internal-combustion engine to this device is necessary.

According to the invention, this objective is met in that either the driving wheel or the driven part is supported on a non-rotating bearing journal.

The driving wheel of a camshaft adjuster is driven by the crankshaft via a traction mechanism or gear drive. The camshaft adjuster is arranged between the crankshaft and the camshaft/s, wherein this is supported on a non-rotating bearing journal. The driven part of the camshaft adjuster is driven by the driving wheel via a hydraulic actuator. The hydraulic actuator essentially is formed of at least two compression chambers acting against each other, wherein an adjustment of the phase between the driving wheel and the driven part is realized through targeted supply of pressurized hydraulic medium to one compression chamber with simultaneous discharge of pressurized hydraulic medium from the other compression chamber. Here, both the use of a rotary piston and also an axial piston adjuster is conceivable.

The driven part is provided with a driving means for each camshaft to be driven. Here, the driving means can be either a chain, belt, or gear. Each camshaft is driven by means of a chain, belt, or gear drive.

In the case of an internal-combustion engine with two banks of cylinders arranged in the shape of a V relative to each other, a camshaft, which activates both the intake and also the exhaust valves, is arranged in each cylinder bank. Arrangements with at least one intake camshaft and at least one exhaust camshaft per cylinder bank are also conceivable. It is provided that in the case of one camshaft per cylinder bank both camshafts, and in the case of several camshafts per cylinder bank either the intake camshafts or the exhaust camshafts are driven by the driven part of the camshaft adjuster. Advantageously, for this controlled drive arrangement, only one camshaft adjuster is needed for driving the intake camshafts or exhaust camshafts, whereby the total rotational moment of inertia can be significantly reduced. In addition to obvious cost advantages, weight advantages and a simpler assembly result from this configuration. In addition, it is guaranteed that the driven camshafts constantly have the same rotational phase relative to the crankshaft, because unintended pressure fluctuations in the pressurized hydraulic medium system of the camshaft adjuster are transferred uniformly to both camshafts. Another advantage emerges from the fact that only one pressurized hydraulic medium supply system has to be integrated into the internal-combustion engine.

In another advantageous configuration of the invention, it is provided that the driving wheel or the driven part is supported by a sliding bearing or a roller bearing on the bearing journal. The use of a bearing reduces frictional losses and thus increases the efficiency of the internal-combustion engine.

Furthermore, it is provided that the hydraulic actuator is supplied with pressurized hydraulic medium via at least one pressurized hydraulic medium line, which is arranged within the bearing journal. Advantageously, a control valve can be provided within the bearing journal for supplying the hydraulic actuator with pressurized medium. In an alternative configuration, the hydraulic actuator is supplied with pressurized hydraulic medium via two pressurized hydraulic medium lines, which are arranged within the bearing journal, wherein each pressurized hydraulic medium line is connected to a compression chamber of the hydraulic actuator. A pressurized hydraulic medium supply embodied in this way through a non-rotating bearing journal eliminates the necessity, as is typical in conventional camshaft adjusters, of feeding the pressurized hydraulic medium to the camshaft adjuster either via the camshaft bearing and the camshaft or alternatively via complicated pressurized hydraulic medium connections.

In one embodiment of the invention, the bearing journal is mounted on the crankcase. Furthermore, it is provided that the bearing journal is mounted by a threaded connection or a non-positive fit on the crankcase. By attaching the non-rotating bearing journal on the crankcase, it is possible to supply the camshaft adjuster with pressurized hydraulic medium through pressurized hydraulic medium lines formed in the crankcase.

In one advantageous embodiment of the invention, it is provided that the bearing journal is provided with means for axial support of the component supported on the journal.

BRIEF DESCRIPTION OF THE DRAWINGS

Additional features of the invention emerge from the following description and from the drawings, in which embodiments of the invention are shown in a simplified form. Shown are.

DETAILED DESCRIPTION OF THE PREFERRED EMBODIMENTS

Figure 1:
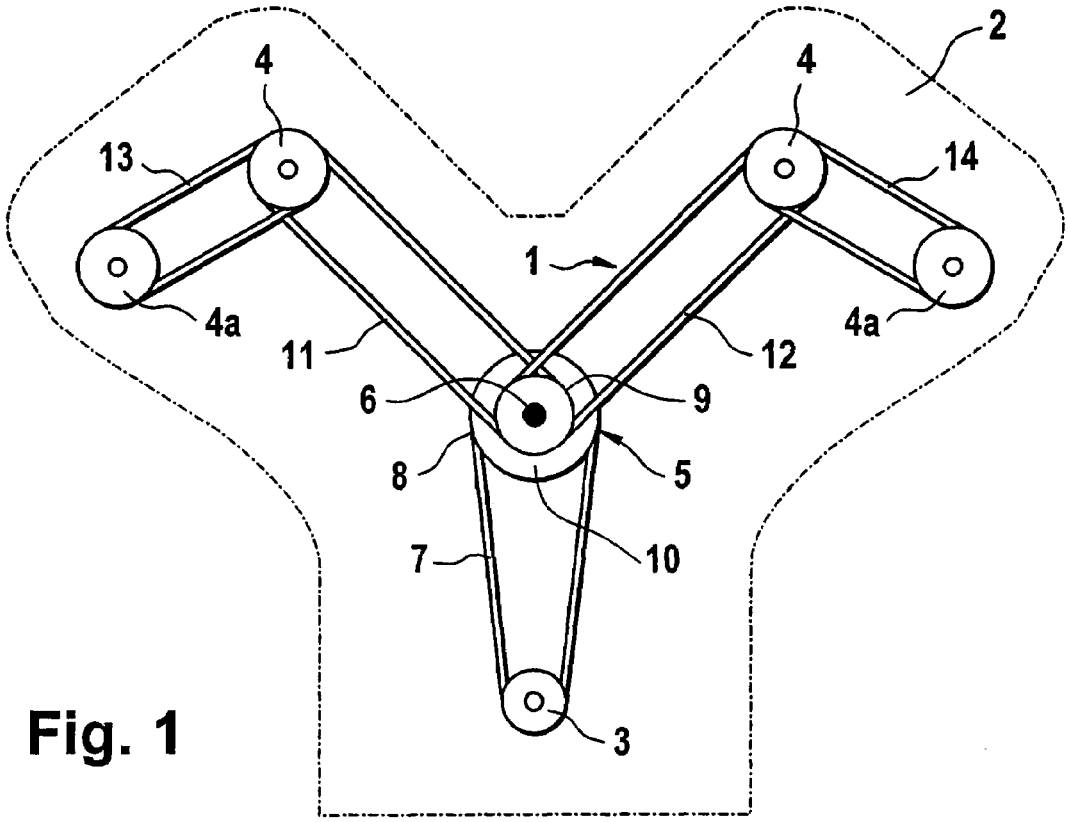
FIG. 1 is a schematic layout of a device according to the invention for changing the timing of an internal-combustion engine.

In FIG. 1, the layout of a device 1 according to the invention for changing the timing of an internal-combustion engine 2 is shown schematically. Here, the invention concerns an internal-combustion engine 2 equipped with two banks of cylinders arranged in the shape of a V, comprising a crankshaft 3, an intake camshaft 4 and an exhaust camshaft 4*a* for each cylinder bank, and a camshaft adjuster 5. The camshaft adjuster 5 is supported on a non-rotating bearing journal 6. A driving wheel 8 of the camshaft adjuster 5 is driven by the crankshaft 3 via a first traction mechanism drive 7. An actuator 10 arranged between the driving wheel 8 and a driven part 9 transfers the rotation of the driving wheel 8 to the driven part 9. The actuator 10, which will be discussed separately below, enables limited relative rotation between the driving wheel 8 and the driven part 9. The driven part 9 is supported rotatably on the non-rotating bearing journal 6. A second and a third traction mechanism drive 11, 12 transfer the rotation of the driven part 9 to the two intake camshafts 4. Each intake camshaft 4 is in driven connection with the appropriate exhaust camshaft 4*a* via another traction mechanism drive 13, 14. In order to change the timing between intake camshaft 4 and exhaust camshaft 4*a*, another camshaft adjuster is to be attached on the drive-side end of each exhaust camshaft 4*a*.

In addition of the configurations of the drives as traction mechanism drives, such as, for example, belt or chain drives, gear drives can also be used. Likewise, it is conceivable to drive the exhaust camshaft 4*a* instead of the intake camshaft 4 or, for only one camshaft per cylinder bank, both camshafts via the driven part 9 of the camshaft adjuster 5. Likewise, the invention can be used in internal-combustion engines 2, in which at least one camshaft is driven via an intermediate element between the camshaft and the crankshaft 3.

Advantageously, this embodiment has the effect that only one camshaft adjuster 5 is needed for driving and for adjusting the two intake camshafts 4. Therefore, in addition to the reduction in weight and cost of the entire system, the assembly expense can also be reduced considerably. In addition, there is a positive effect on the significantly increased angle of belt wrap of the driving wheels. Therefore, the forces on individual teeth of the driving wheels and the risk of skipping by the chain and the toothed belt are minimized.

Figure 3:
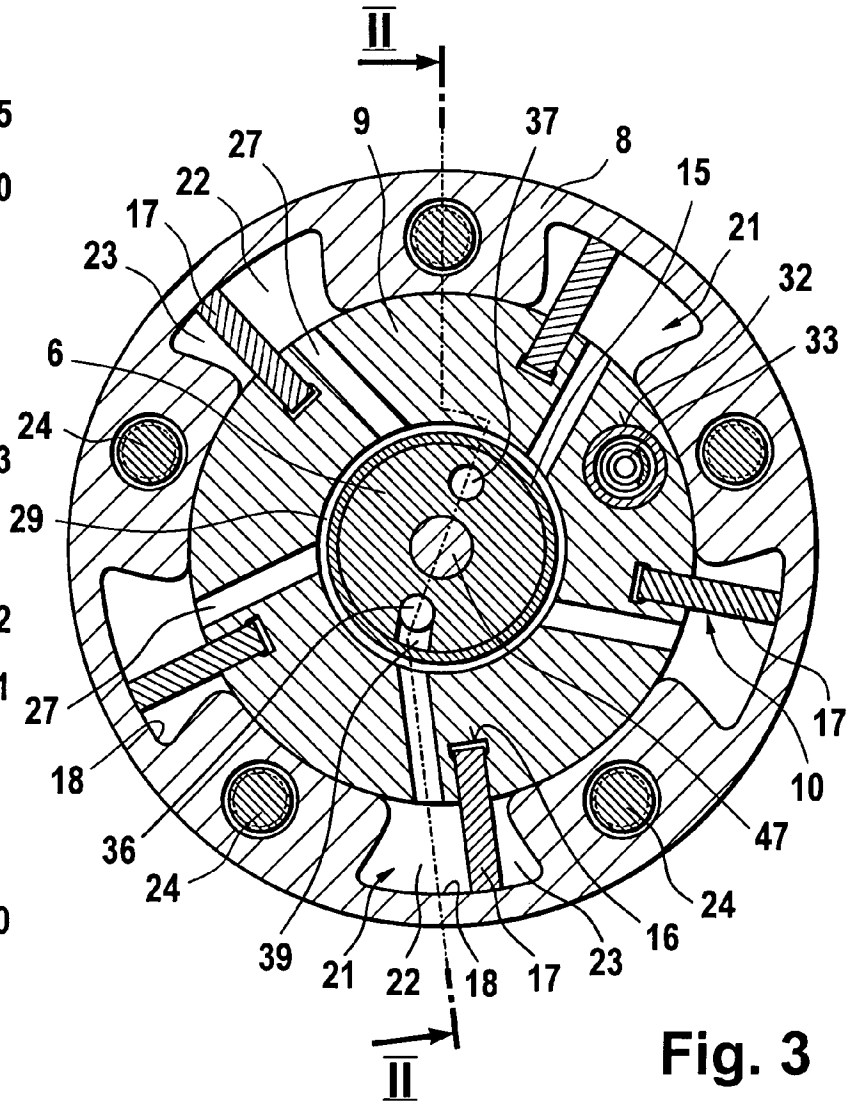
FIG. 3 is a cross sectional view through the camshaft adjuster from FIG. 2 along the line III-III.
Figure 2:
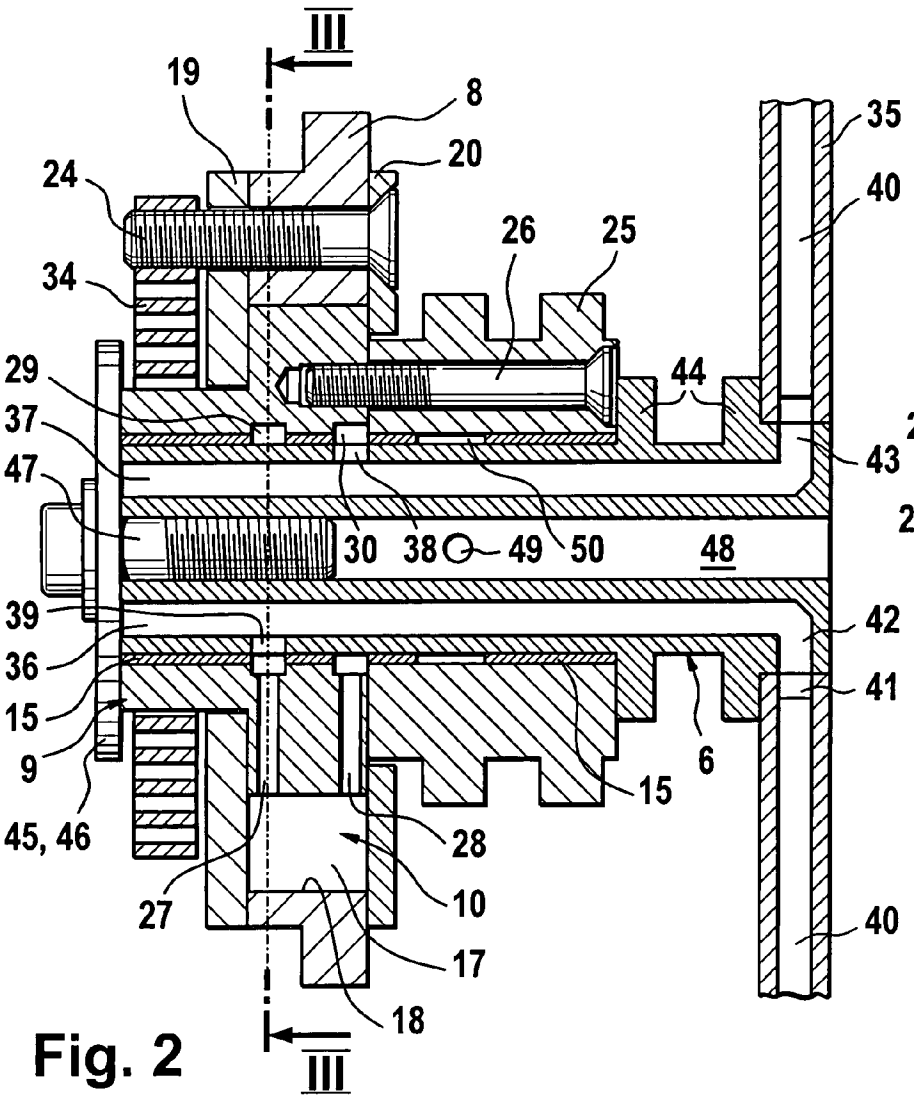
FIG. 2 is a longitudinal section through a camshaft adjuster supported on a non-rotating bearing journal from the device according to the invention from FIG. 1, along the line II-II in FIG. 3.

FIG. 2 and FIG. 3 show as examples the layout of a camshaft adjuster 5, which can be used in the device 1 according to the invention for changing the timing of an internal-combustion engine 2.

The driven part 9 is supported by bearing means 15 on the non-rotating bearing journal 6. Several axial grooves 16, in which radially extending vanes 17 are arranged, are formed in the at least partially cylindrical outer surface of the driven part 9.

The hollow cylindrical driving wheel 8 is arranged concentric to the driven part 9. Here, the inner diameter of the driving wheel 8 is adapted essentially to the outer diameter of the driven part 9. The inner surface of the driving wheel 8 is provided with several radial recesses 18. The recesses 18 form compression chambers 21 in interaction with the driving wheel 8, the driven part 9, and two side covers 19, 20 arranged axially thereto, wherein a vane 17 extends into each compression chamber 21 starting from the driven part 9. Each vane 17 divides a compression chamber 21 into a first and a second compression chamber 22, 23.

Instead of the vane 17, which are arranged in the axial grooves 16 of the driving part, suitably formed depressions can be formed integrally with the driven part 9, which engage in the compression chambers 21 and divide into two compression chambers 22, 23.

The side covers 19, 20 are connected to the driving wheel 8 by first fastening means 24, for example, screws or bolts.

The driven part 9 is provided with driving means 25. Here, driving means 25 are provided for each camshaft 4 to be driven. The driven part 9 and the driving means 25 can be configured in one piece. Furthermore, it is conceivable that the driven means 25 are configured separately from the driven part 9 and connected to this driven part by means of second fastening means 26. Here, non-positive, positive, or friction-fit connections, such as, for example, weld connections, interference fits, screw connections, or the use of positive-fit means, such as, e.g., tongue-and-groove connections or gear connections, are conceivable. Both the driving wheel 8 and also the driving means 25 can be configured, for example, as chains, belts, or gears, which are arranged in a chain, belt, or gear drive. Each of the first compression chambers 22 communicates via a first pressurized hydraulic medium line 27 with a first annular groove 29 formed in the driven part 9. Analogously, each of the second compression chambers 23 communicates via a second pressurized hydraulic medium line 28 with a second annular groove 30 formed in the driven part 9. In order to adjust the phase between the driven part 9 and the driving wheel 8, either the first or the second compression chambers 22, 23 are pressurized with pressurized hydraulic medium via the corresponding annular groove 29, 30 and the corresponding pressurized hydraulic medium line 27, 28. Simultaneously, the other compression chambers 22, 23 are connected to a pressurized hydraulic medium reservoir 31 via the corresponding pressurized hydraulic medium lines 27, 28 and the corresponding annular groove 29, 30. Therefore, the volume of each compression chamber 22, 23 that is pressurized with pressurized hydraulic medium increases while the pressurized hydraulic medium is bled off from the other compression chambers 22, 23 into the pressurized hydraulic medium reservoir 31 and thus their volume is reduced. This results in movement by the vane 17 within the compression chambers 21, whereby the phase of the driven part 9 changes relative to the driving wheel 8.

A locking element 33 is attached within an axial bore 32 of the driven part 9. The locking element 33 includes a spring-loaded piston, which is pressed into a connecting element formed in the first side cover 19 at a certain phase position of the driven part 9 relative to the driving wheel 8, which advantageously corresponds to the phase position of the camshaft adjuster 5 at the start of the internal-combustion engine 2, and thus prevents rotation of the driven part 9 relative to the driving wheel 8. In addition, a spring element 34 is provided, which is connected both with the driving wheel 8 and also with the driven part 9. The forces exerted by the spring element 34 on the driven part 9 and the driving wheel 8 are directed so that these components are rotated into a position for insufficient pressurized hydraulic medium filling of the compression chambers 22, 23, so that the locking element 33 can engage in the connecting element provided for this purpose in the first side cover 19. Furthermore, not-shown means are provided, which detach the locking mechanism for sufficient pressurized hydraulic medium filling of the compression chambers 22, 23.

The driven part 9 is arranged on the non-rotating bearing journal 6 via bearing means 15. The bearing means 15 can be provided either as a roller bearing or as a sliding bearing. The bearing journal 6 is advantageously mounted in a rotationally fixed manner to a crankcase 35. For this purpose, the end of the bearing journal 6 arranged within the crankcase 35 can be provided with a screw thread and the connection between the bearing journal 6 and crankcase 35 can be manufactured as a screw connection. However, other positive and non-positive or friction-fit connections, such as adhesive connections, weld connections, or interference-fit connections are also possible.

Two pressurized hydraulic medium channels 36, 37 are formed within the bearing journal 6. Each of the pressurized hydraulic medium channels 36, 37 connects either to the first compression chambers 22 or to the second compression chambers 23 via an opening 38, 39, via an annular groove 29, 30, and via the associated pressurized hydraulic medium lines 27, 28. Now, pressurized hydraulic medium can be guided, for example, by means of an oil gallery 40 formed in the crankcase 35, via the pressurized hydraulic medium channels 36, 37 into the compression chambers 22, 23 or the compression chambers 22, 23 can be emptied via the pressurized hydraulic medium channels 36, 37.

The connection between the oil gallery 40 and the pressurized hydraulic medium channels 36, 37 is created by grooves 41, which are formed in the crankcase 35. The pressurized hydraulic medium channels 36, 37 communicate with the grooves 41 via a first and a second radial junction bore hole 42, 43. Here, the first and second junction bore holes 42, 43 can be offset axially relative to each other and the grooves 41 can be embodied as annular grooves. This embodiment has the advantage that a certain orientation does not have to maintained for the assembly of the bearing journal 6. One solution, in which the grooves 41 extend only partially around the bearing journal 6 and the axial positions of the junction bore holes 42, 43 are identical or at least nearly identical, reduces the necessary wall thickness of the crankcase 35 at the connecting point to the bearing journal 6.

The bearing journal 6 is connected to the crankcase 35 at its crank-case-side end by an interference fit. Furthermore, the bearing journal 6 is provided with means for axial fixing of the driven part 9. In the shown embodiment, this is provided as a radial collar 44 formed integrally with the bearing journal 6. These means can also be used as an axial stop in the production of the interference fit between the bearing journal 6 and the crankcase 35.

A component 45 is provided on the end face of the bearing journal 6 facing away from the crankcase 35 in the axial direction, wherein this component 45 extends in the radial direction at least into the region of the driven part 9. The driven part 9, and thus the camshaft adjuster 5, are fixed axially between the collar 44 and the component 45.

The bearing journal 6 itself can be embodied in two parts. In this case, it comprises a sleeve, on which the driven part 9 of the camshaft adjuster 5 is supported so that it can rotate. The sleeve is connected to the crankcase 35 in a non-positive manner. A pressurized hydraulic medium distributor is located within the sleeve. The pressurized hydraulic medium distributor is provided on the crankcase-side end with fastening means, with which it is connected to the sleeve. This can be realized, for example, by a threaded connection. The part of the pressurized hydraulic medium distributor arranged within the sleeve is provided with two axial recesses, which form the pressurized hydraulic medium channels 36, 37. A screw head is formed on the end face of the pressurized hydraulic medium distributor facing away from the crankcase 35, wherein the screw head projects past the driven part 9 in the radial direction and thus forms the axial bearing.

In the embodiment shown in FIG. 2, the bearing journal 6 is embodied in one part. In this case, the crankcase-side end of the bearing journal 6 is connected in turn to the crankcase 35 with a non-positive fit. Within the bearing journal 6, two bore holes are formed, which form the pressurized hydraulic medium channels 36, 37. The annular grooves 29, 30 are each connected to one of the pressurized hydraulic medium channels 36, 37 via a junction bore hole. On the end face of the bearing journal 6 facing away from the crankcase 35, an annular disk 46 is formed, which projects past the driven part 9 of the camshaft distributor 5 in the radial direction. The disk 46 is mounted on the bearing journal 6 by a suitable third fastening means 47, for example, screws, and is used as axial bearing for the camshaft adjuster 5. The disk 46 closes the pressurized hydraulic medium channels 36, 37 in the axial direction.

Advantageously, the bearing journal 6 is provided with an axial bore hole 48, by which a third annular groove 50 is supplied with motor oil by a third junction bore hole 49. The third annular groove 50 is formed within the bearing means 15 and guarantees it is supplied with sufficient lubricating means.

Figure 4:
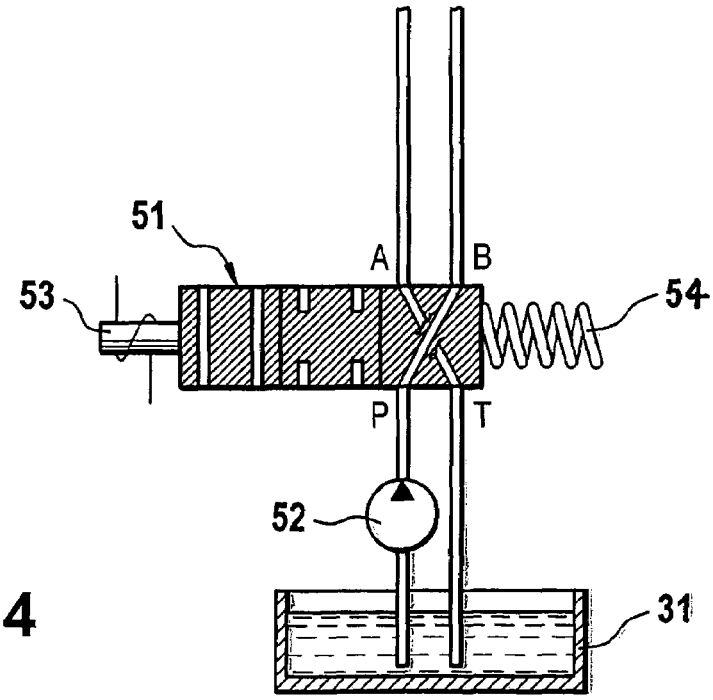
FIG. 4 is a schematic illustration of a control valve, which regulates the supply of pressurized hydraulic medium to the hydraulic camshaft adjuster.

In order to supply the compression chambers 22, 23 with pressurized hydraulic medium, a control valve 51 is used. The control valves 51 are usually realized as 4/3 proportional valves and described in detail in the state of the art. FIG. 4 shows a schematic illustration of such a control valve 51. The control valve 51 has four connections A, B, P, T. The connection P is connected to a pressurized hydraulic medium pump 52, the connection A to the first compression chamber 22, the connection B to the second compression chamber 23, and the connection T to the pressurized hydraulic medium reservoir 31. The control valve 51 has essentially 3 different switch positions. In a first switch position, the connection A is connected to the pressurized hydraulic medium pump 52, while the connection B communicates with the pressurized hydraulic medium reservoir 31. The volume of the first compression chamber 22 increases, while the volume of the second compression chamber 23 decreases. Consequently, the driven part 9 rotates relative to the driving wheel 8 in a first direction of rotation. In a second switch position, the connection A and the connection B are connected neither to the pressurized hydraulic medium pump 52 nor to the pressurized hydraulic medium reservoir 31. Thus there is no relative rotation between the driven part 9 and the driving wheel 8. In a third switch position, the connection B is connected to the pressurized hydraulic medium pump 52, while the connection A communicates with the pressurized hydraulic medium reservoir 31. The volume of the first compression chamber 22 decreases, while the volume of the second compression chamber 23 increases. Consequently, the driven part 9 rotates relative to the driving wheel 8 in a second direction of rotation, wherein this direction is opposite the first direction of rotation.

The various switch positions are assumed through axial displacement of a valve piston within a valve body. For this purpose, in general an electromagnetically activated linear drive 53 is used, which works against the spring force of a spring 54.

The control valve 51 can be arranged within the crankcase 35. The connections A and B are then connected to the pressurized hydraulic medium channels 36, 37 via pressurized hydraulic medium lines.

It is also conceivable to arrange the control valve 51 within the bearing journal 6. In this case, pressurized hydraulic medium is supplied to the control valve 51 via a pressurized hydraulic medium channel from the oil gallery 40 in the crankcase. The pressurized hydraulic medium is distributed to the compression chambers 22, 23 according to the switch position of the control valve 51.

REFERENCE SYMBOLS

1 Device
2 Internal-combustion engine
3 Crankshaft
4 Intake camshaft
4*a* Exhaust camshaft
5 Camshaft adjuster
6 Bearing journal
7 First traction mechanism drive
8 Driving wheel
9 Driven part
10 Actuator
11 Second traction mechanism drive
12 Third traction mechanism drive
13 Fourth traction mechanism drive
14 Fifth traction mechanism drive
15 Bearing means
16 Axial groove
17 Vane
18 Recesses
19 First side cover
20 Second side cover
21 Compression chamber
22 First compression chamber
23 Second compression chamber
24 First fastening means
25 Drive means
26 Second fastening means
27 First pressurized hydraulic medium line
28 Second pressurized hydraulic medium line
29 First annular groove
30 Second annular groove
31 Pressurized hydraulic medium reservoir
32 Axial bore hole
33 Locking element
34 Spring element
35 Crankcase
36 First pressurized hydraulic medium channel
37 Second pressurized hydraulic medium channel
38 First opening
39 Second opening
40 Oil gallery
41 Groove
42 First junction bore hole
43 Second junction bore hole
44 Collar
45 Component
46 Disk
47 Third fastening means
48 Bore hole
49 Third junction bore hole
50 Third annular groove
51 Control valve
52 Pressurized hydraulic medium pump
53 Linear drive
54 Spring
A Connection
B Connection
P Connection
T Connection

The invention claimed is:

1. A device (1) for changing the timing of an internal-combustion engine (2) comprising a camshaft adjuster (5) including a driving wheel (8) driven by a crankshaft (3) and a driven part (9) driving at least one camshaft (4), the driven part is driven by the driving wheel (8) via a hydraulic actuator (10), wherein the hydraulic actuator (10) is formed with at least one pair of hydraulic compression chambers (22, 23) working against each other, and wherein a phase position between the crankshaft (3) and the at least one camshaft (4) can be changed via the actuator (10), either the driving wheel (8) or the driven part (9) surrounds a non-rotating bearing journal (6) and is supported directly on the non-rotating bearing journal (6), and the bearing journal (6) is mounted on a crankcase (35) of the engine.

2. The device (1) according to claim 1, wherein the driving wheel (8) or the driven part (9) is supported by a sliding bearing on the bearing journal (6).

3. The device (1) according to claim 1, wherein the driving wheel (8) or the driven part (9) is supported by a roller bearing on the bearing journal (6).

4. The device (1) according to claim 1, wherein the hydraulic actuator (10) is supplied with pressurized hydraulic medium via at least one pressurized hydraulic medium channel 36, 37, which is arranged within the bearing journal (6).

5. The device (1) according to claim 1, wherein a control valve (51) is provided within the bearing journal (6) for supplying the hydraulic actuator (10) with pressurized hydraulic medium.

6. The device (1) according to claim 1, wherein the hydraulic actuator (10) is supplied with pressurized hydraulic medium via two pressurized hydraulic medium channels 36, 37, which are arranged within the bearing journal (6), wherein each of the pressurized hydraulic medium channels 36, 37 is connected to a respective one of the compression chambers (22, 23) of the hydraulic actuator (10).

7. The device (1) according to claim 1, wherein the bearing journal (6) is mounted on the crankcase (35) by a threaded connection.

8. The device (1) according to claim 1, wherein the bearing journal (6) is mounted on the crankcase (35) with a non-positive fit.

9. The device (1) according to claim 1, wherein the bearing journal (6) is provided with means for axial support of the driving wheel or the driven part supported on the journal.

10. A camshaft adjuster (5) for changing the timing of an internal-combustion engine (2) having two banks of cylinders arranged in a V shape, the internal-combustion engine (2) comprising a crankshaft (3), and an intake camshaft (4) for each cylinder bank, the camshaft adjuster (5) comprising:

a driving wheel (8) driven by the crankshaft (3) via a driving traction mechanism drive (7);

a driven part (9) driving each camshaft (4) via respective driven traction mechanism drives (11, 12);

a non-rotating bearing journal (6) directly supporting either the driving wheel (8) or the driven part (9); and a hydraulic actuator (10) arranged between the driving wheel (8) and the driven part (9) that transfers rotation of the driving wheel (8) to the driven part (9), wherein the driven part (9) is driven by the driving wheel (8) via the hydraulic actuator (10), and a phase position between the crankshaft (3) and the camshafts (4) can be changed via the actuator (10).

* * * * *